US009098009B2

(12) United States Patent
Tosuji et al.

(10) Patent No.: US 9,098,009 B2
(45) Date of Patent: Aug. 4, 2015

(54) DEVELOPING DEVICE

(71) Applicant: Brother Kogyo Kabushiki Kaisha, Nagoya-shi, Aichi-ken (JP)

(72) Inventors: Kenta Tosuji, Nagoya (JP); Masahiro Ishii, Nagoya (JP); Takanori Uno, Nisshin (JP); Takuya Amaike, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/520,088

(22) Filed: Oct. 21, 2014

(65) Prior Publication Data

US 2015/0110521 A1 Apr. 23, 2015

(30) Foreign Application Priority Data

Oct. 21, 2013 (JP) ..... 2013-218687

(51) Int. Cl.
*G03G 15/08* (2006.01)

(52) U.S. Cl.
CPC ..... *G03G 15/081* (2013.01); *G03G 15/0817* (2013.01); *G03G 15/0898* (2013.01)

(58) Field of Classification Search
CPC ..... G03G 15/0817; G03G 15/0898
USPC ..... 399/102, 103, 105, 274, 278
See application file for complete search history.

(56) References Cited

U.S. PATENT DOCUMENTS 7,463,843 B2 * 12/2008 Kawai ..... 399/103
8,855,526 B2 * 10/2014 Ito et al. ..... 399/103

FOREIGN PATENT DOCUMENTS

JP 2010-164736 A 7/2010

* cited by examiner

*Primary Examiner* — Hoang Ngo
(74) *Attorney, Agent, or Firm* — Banner & Witcoff, Ltd.

(57) ABSTRACT

A developing device including a housing, a developing roller, a seal member arranged between the housing and each end of the developing roller, and a layer thickness regulation blade including a blade main body, and a blade rubber part protruding from a surface of the blade main body and contacting the developing roller, wherein an end surface of the blade rubber part in an axial direction of the developing roller is in contact with an inner surface of the seal member in the axial direction, and wherein the blade rubber part has an inclined surface at each end thereof in the axial direction, the inclined surface extending toward an upstream side in a rotating direction of the developing roller while extending toward an outer side in the axial direction so as to extend to the seal member.

9 Claims, 10 Drawing Sheets

DEVELOPING DEVICE

CROSS-REFERENCE TO RELATED APPLICATIONS

This application claims priority from Japanese Patent Application No. 2013-218687 filed on Oct. 21, 2013, the entire contents of which are incorporated herein by reference.

TECHNICAL FIELD

Aspects of the invention relate to a developing device having a developing roller and a layer thickness regulation blade.

BACKGROUND

A known developing device used in an image forming apparatus includes a housing for accommodating developer therein, a developing roller rotatably held in the housing, a layer thickness regulation blade contacting the developing roller and a seal member arranged between the housing and the developing roller (see, for example, JP-A-2010-164736). In this developing device, the layer thickness regulation blade has a blade main body made of sheet metal and a blade rubber part protruding from the blade main body and contacting the developing roller.

The seal member is provided in a shape following an outer peripheral surface of the developing roller and one end thereof is adhered to each end portion of the blade main body. Further, an end surface of the seal member at an inner side in an axial direction of the developing roller is in contact with an end surface of the blade rubber part at an outer side in the axial direction of the developing roller.

SUMMARY

However, in the above-described technique, the developer scraped off by the end portion of the blade rubber part may vigorously flow toward the seal member, depending on the shape of the blade rubber part. In this case, it is difficult to completely seal the developer by the seal member. Accordingly, there is a possibility that the developer is leaked to the outside.

Accordingly, aspects of the invention provide a developing device capable of suppressing developer from being leaked.

According to an aspect of the invention, there is provided a developing device including a housing configured to accommodate developer therein, a developing roller rotatably provided to the housing and configured to carry the developer on a surface thereof, a layer thickness regulation blade contacting the developing roller, and a seal member arranged between the housing and each end of the developing roller in an axial direction of the developing roller, wherein the layer thickness regulation blade includes a blade main body extending along the axial direction, and a blade rubber part protruding from a surface of the blade main body, which faces the developing roller, and contacting the developing roller, wherein an end surface of the blade rubber part in the axial direction is in contact with an inner surface of the seal member in the axial direction, and wherein the blade rubber part has an inclined surface at each end thereof in the axial direction, the inclined surface extending toward an upstream side in a rotating direction of the developing roller while extending toward an outer side in the axial direction so as to extend to the seal member.

According to the developing device configured as described above, since the developer scraped off by the inclined surface of the blade rubber part moves along the inclined surface, the developer moves toward the inner side of the developing roller in the axial direction, i.e., toward the side opposite to the seal member. Accordingly, since the developer scraped off by the inclined surface does not vigorously flow to the seal member, it is possible to suppress leakage of the developer.

BRIEF DESCRIPTION OF DRAWINGS

FIG. 5A is a view showing a structure that has an inclined surface and FIG. 5B is a view showing a structure that does not have an inclined surface;

FIG. 6A is a sectional view at a central portion in a left-right direction and FIG. 6B is a sectional view at a cutout portion;

DETAILED DESCRIPTION

Hereinafter, an illustrative embodiment of the invention will be specifically described with reference to the drawings. In the following descriptions, an overall configuration of a laser printer will be first described briefly and then features of the invention will be specifically described.

Further, in the following descriptions, directions are described, based on a user who is using a laser printer 1. That is, in FIG. 1, the left side is referred to as the 'front side', the right side is referred to as the 'rear side', the inner side is referred to as the 'left side' and the front side is referred to as the 'right side'. Also, the upper and lower directions in FIG. 1 are referred to as the 'upper-lower direction'.

<Overall Configuration of Laser Printer>

Figure 1:
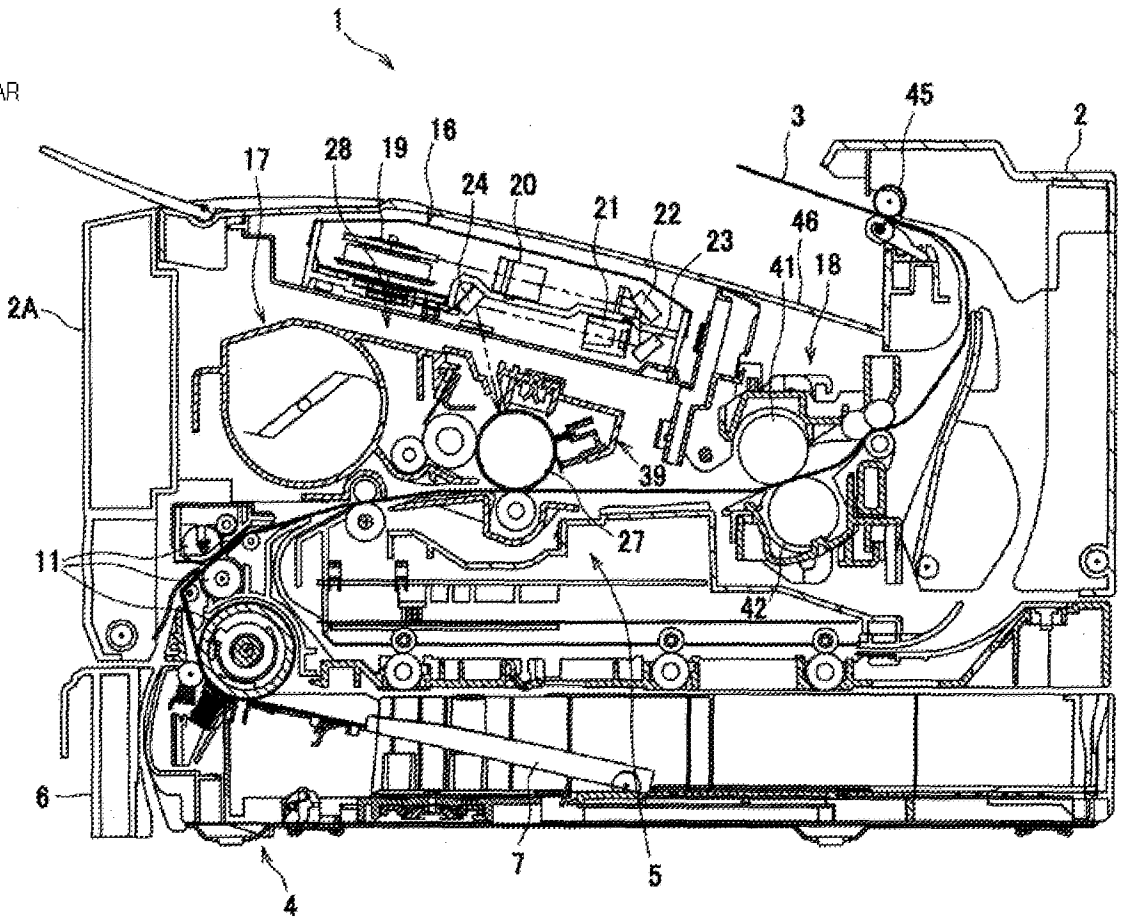
FIG. 1 is a sectional view showing a schematic configuration of a laser printer having a developing cartridge according to an illustrative embodiment of the invention.

As shown in FIG. 1, the laser printer 1 has a feeder unit 4 for feeding a sheet 3 into a main body casing 2 and an image forming unit 5 for forming an image on the sheet 3, and the like.

The feeder unit 4 has a sheet feeding tray 6 detachably mounted to an inner bottom portion of the main body casing 2 and a sheet pressing plate 7 provided in the sheet feeding tray 6. Further, the feeder unit 4 has various rollers 11 for conveying the sheet 3 and removing paper dust. In the feeder unit 4, the sheet 3 in the sheet feeding tray 6 is sent upward by the sheet pressing plate 7 and then conveyed to the image forming unit 5 by various rollers 11.

The image forming unit 5 has a scanner unit 16, a process cartridge 17, a fixing unit 18 and the like.

The scanner unit 16 is provided to an upper portion inside the main body casing 2 and has a laser light emitting unit (not shown), a polygon mirror 19 that is rotationally driven, lenses 20, 21, reflectors 22, 23, 24 and the like. In the scanner unit 16, a laser beam passes through a route indicated by a chain line and is irradiated on a surface of a photosensitive drum 27 by high-speed scanning.

The process cartridge 17 can be detachably mounted to the main body casing 2 by appropriately opening a front cover 2A provided at the front side of the main body casing 2. Further, the process cartridge 17 is configured mainly by a drum unit 39 and a developing cartridge 28 as an example of the developing device.

Figure 2:
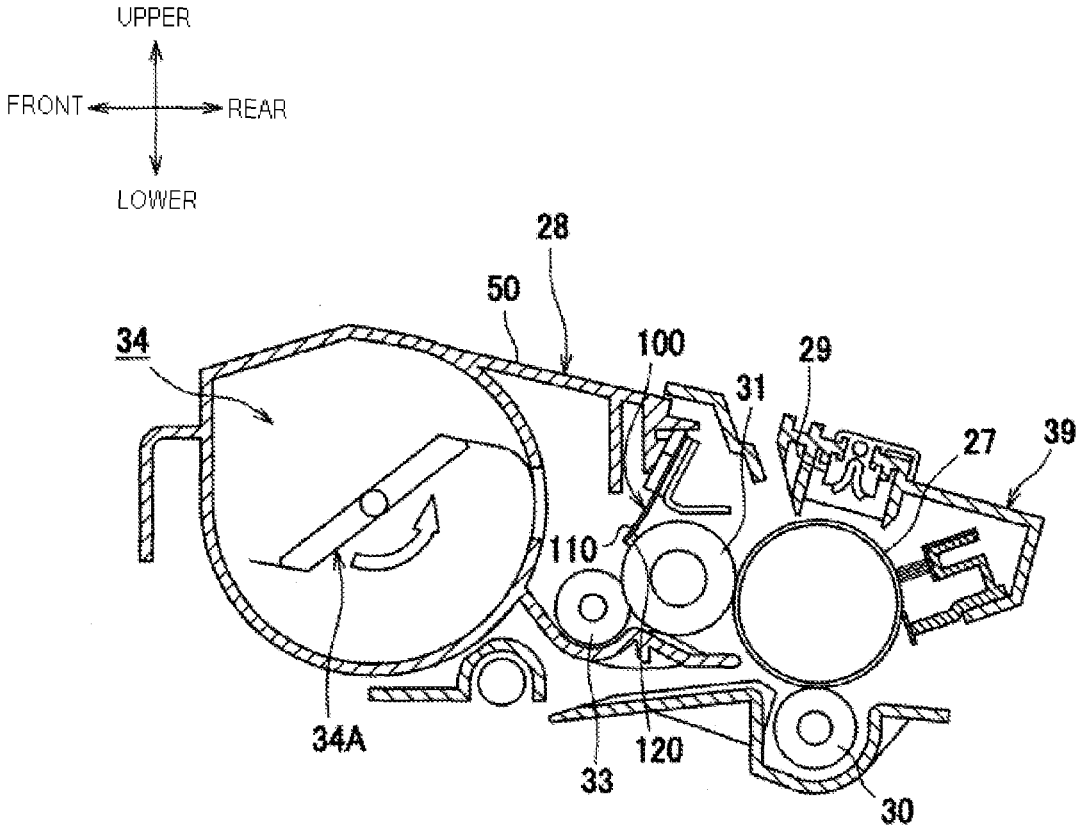
FIG. 2 is a sectional view of a process cartridge.

The developing cartridge 28 can be attached to and detached from the main body casing 2 in a state of being mounted to the drum unit 39. As shown in FIG. 2, the developing cartridge 28 has a developing roller 31, a layer thickness regulation blade 100, a supply roller 33 and a housing 50 for supporting these components. Further, the housing 50 has a toner accommodation chamber 34 in which toner as an example of a developer is accommodated.

The layer thickness regulation blade 100 has a blade main body 110 and a blade rubber part 120 fixed to the blade main body 110.

The blade main body 110 is a sheet metal extending in a left-right direction. The blade main body 110 is fixed to the housing 50 above the developing roller 31 and a leading end thereof is arranged in front of the developing roller 31.

Figure 3:
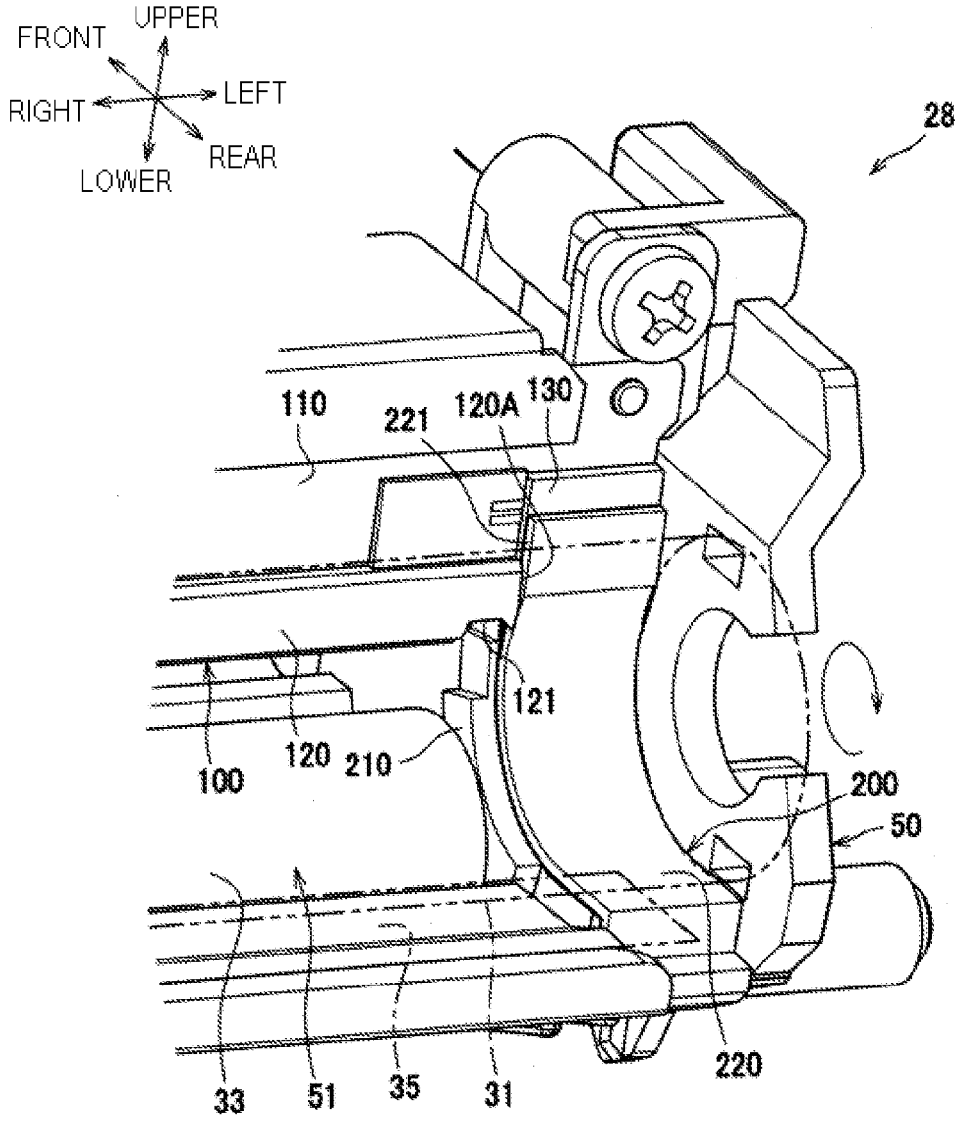
FIG. 3 is an enlarged perspective view showing a structure around an opening of the developing cartridge.

As shown in FIG. 3, the blade rubber part 120 is a rubber member that is elongated in the left-right direction and has a size in the left-right direction smaller than that of the blade main body 110. The blade rubber part 120 is formed by silicone rubber or urethane rubber and the like. The blade rubber part 120 protrudes from a surface of the leading end portion of the blade main body 110, which is opposed to the developing roller 31, and is brought into contact with the developing roller 31. The surface of the blade rubber part 120, which is in contact with the developing roller 31, has a flat shape. The corners of the blade rubber part 120, which are located at an upstream side and a downstream side in a rotating direction of the developing roller 31, have an arc shape in a sectional view (see FIG. 6A).

Returning back to FIG. 2, in the developing cartridge 28, the toner accommodated in the toner accommodation chamber 34 is stirred by an agitator 34A and then supplied to the developing roller 31 by the supply roller 33. At this time, the toner is friction-charged between the supply roller 33 and the developing roller 31. As the developing roller 31 is rotated, the toner carried by an outer peripheral surface of the developing roller 31 is introduced between the layer thickness regulation blade 100 and the developing roller 31. Then, the toner is carried on the developing roller 31 as a thin layer having a constant thickness while being further friction-charged therebetween.

The drum unit 39 has the photosensitive drum 27, a scorotron type charger 29 and a transfer roller 30. In the drum unit 39, a surface of the photosensitive drum 27 is uniformly positively-charged by the scorotron type charger 29 and then exposed by the high-speed scanning of the laser beam emitted from the scanner unit 16. Thereby, a potential of the exposed part is lowered and therefore an electrostatic latent image based on image data is formed.

Then, as the developing roller 31 is rotated, the toner carried on the developing roller 31 is supplied to the electrostatic latent image formed on the surface of the photosensitive drum 27, so that a toner image is formed on the surface of the photosensitive drum 27. After that, the sheet 3 is conveyed between the photosensitive drum 27 and the transfer roller 31, so that the toner image carried on the surface of the photosensitive drum 27 is transferred onto the sheet 3.

As shown in FIG. 1, the fixing unit 18 has a heating roller 41 and a pressing roller 42. The pressing roller 42 is disposed so as to face the heating roller 41 and presses the heating roller 41. In the fixing unit 18 configured as described above, the toner transferred onto the sheet 3 is heat-fixed while the sheet 3 passes between the heating roller 41 and the pressing roller 42. The sheet 3 heat-fixed by the fixing unit 18 is conveyed to a discharge roller 45 disposed at a downstream side of the fixing unit 18 and discharged onto a discharge tray 46 from the discharge roller 45.

<Detailed Configuration of Developing Cartridge>

Subsequently, the configuration of the developing cartridge 28 will be specifically described. FIG. 3 shows a state where the developing roller 31 is detached from the housing 50. Here, the configurations around an opening 51 of the developing cartridge 28 are substantially the same in the left end portion and the right end portion. Accordingly, only the left end portion is shown in the drawings referred to in the following descriptions.

As shown in FIG. 3, the housing 50 of the developing cartridge 28 has an opening 51 formed to its rear sidewall. The developing roller 31 is rotatably supported by the housing 50 so as to block the opening 51. A film 35 is provided at the lower edge of the opening 51. A side seal 200 as an example of the seal member is provided at both left and right edges of the opening 51. Further, the layer thickness regulation blade 100 is provided at the upper edge of the opening 51 so as to extend in the left-right direction.

The side seal 200 is disposed between the housing 50 and both ends of the developing roller 31 in an axial direction (i.e., the left-right direction) of the developing roller 31, so as to follow an outer peripheral shape of the developing roller 31. The side seal 200 is in contact with the developing roller 31. Further, the film 35 is a sheet-like member extending in the left-right direction and is in contact with the lower portion of the developing roller 31. In the layer thickness regulation blade 100, the blade rubber part 120 is in contact with the developing roller 31 obliquely from the upper front side (see FIG. 2). As described above, in order to prevent the toner in the housing 50 from leaking around the developing roller 31, the developing roller 31 is in close contact with the layer thickness regulation blade 100, the film 35 and the side seal 200 at the left, right, top and bottom thereof. Meanwhile, in the illustrative embodiment, the developing roller 31 is provided so as to rotate in a direction indicated by an arrow in FIG. 3, i.e., a direction in which a peripheral surface of the developing roller 31 scrubs the surface of the side seal 200 from the bottom to the top.

Figure 4:
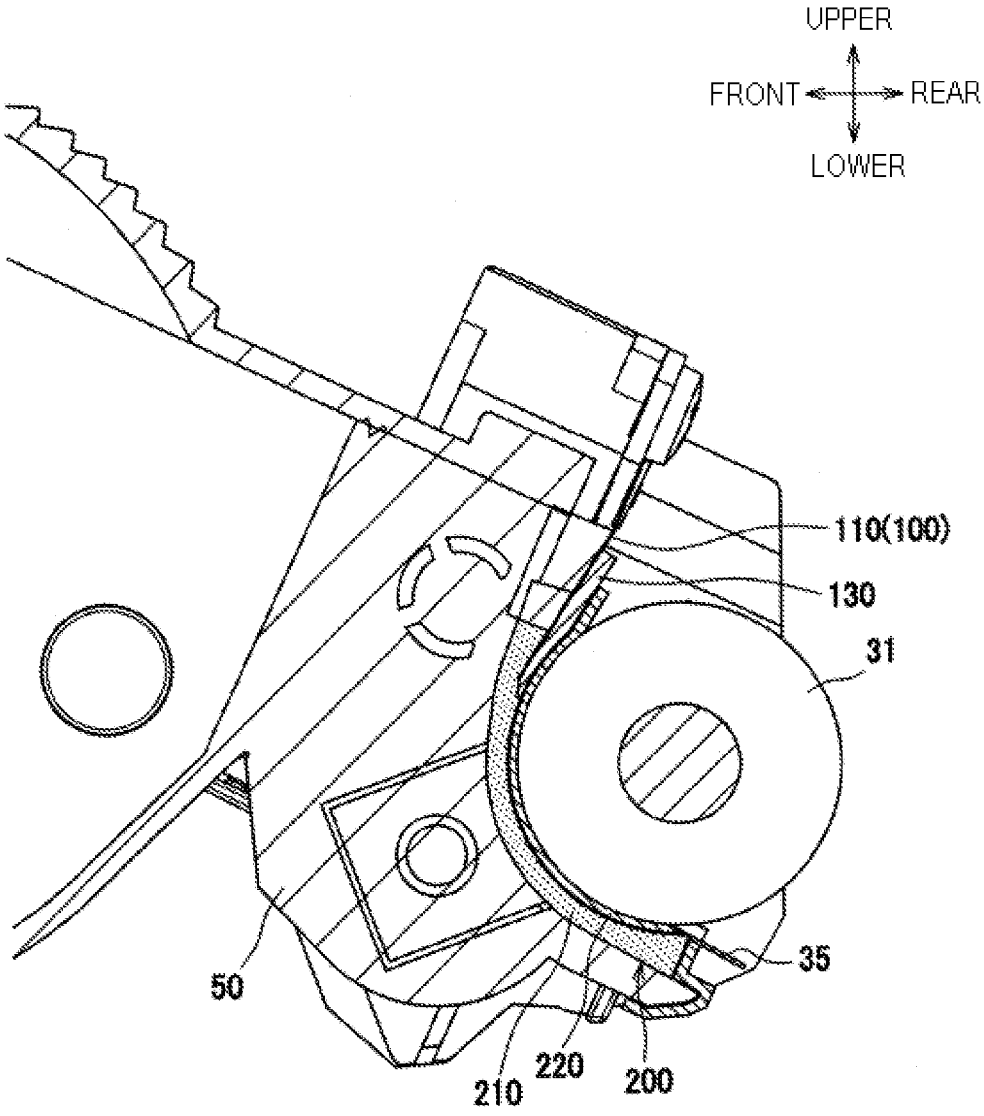
FIG. 4 is a sectional view of the developing cartridge, taken along a plane perpendicular to an axial direction of a developing roller through a side seal.

As shown in FIG. 3 and FIG. 4, the side seal 200 has a base member 210 adhered to the housing 50 and a contact member 220 that is in contact with the developing roller 31 while being superimposed on the base member 210.

The base member 210 is an elastic member formed of urethane sponge, for example. A lower end of the base member 210 is disposed at the lower side of the developing roller 31 and an upper end thereof is disposed at the back side (front side) of the blade main body 110 of the layer thickness regulation blade 100. The base member 210 is in contact with the blade main body 110 from the side opposite to the developing roller 31. The base member 210 is adhered to the housing 50 by a double-sided tape and the like.

Meanwhile, a blade-side seal 130 made of urethane sponge and the like is adhered to the surface of the fore side (rear side) of the blade main body 110 while being adjacent to both sides of the blade rubber part 120.

The contact member 220 is a substantially rectangular member formed from fiber members such as non-woven fabrics or textile members, for example. The contact member 220 extends from a position superimposed on the blade-side seal 130 towards the rear side than the lower end of the base member 210. The contact member 220 is adhered to the blade-side seal 130, the base member 210 and a portion of the housing 50 extending to the rear side than the lower end of the base member 210 by a double-sided tape and the like. Further, an upper end of the contact member 220 is placed above the contact portion of the blade rubber part 120 with the developing roller 31 (see FIG. 5A). Meanwhile, a material of the contact member 220 may be a pile fabric, felt, or Dyneema (product manufactured by Toyobo Co., Ltd.). Further, in the case of using the fibers of the pile fabric or the fibers of Dyneema, it is desirable that the fibers are woven in a manner slanted toward an upper side and toward an inner side in the left-right direction. Further, it is desirable that the slant angle thereof is substantially the same as an angle of an inclined surface 122 to an axis of the developing roller.

As shown in FIG. 5, the blade rubber part 120 of the layer thickness regulation blade 100 has an end surface 120A in the left-right direction. The end surface 120A is in contact with an inner end surface 221 of the contact member 220 in the left-right direction. Further, the blade rubber part 120 is provided with a cutout portion 121 at both ends thereof in the left-right direction. The cutout portion 121 is formed in a shape recessed upward. Meanwhile, a leading end of the blade main body 110 is formed in a shape corresponding to the blade rubber part 120 and both ends thereof in the left-right direction extend toward an outer side than the blade rubber part 120.

The cutout portion 121 has the inclined surface 122. The inclined surface 122 extends from a lower end of the end surface 120A of the blade rubber part 120 in the left-right direction to incline upward toward an inner side in the left-right direction. That is, the inclined surface 122 is a surface inclined with respect to the axial direction of the developing roller 31, and extends toward the lower side which is an upstream side in the rotating direction of the developing roller 31 while extending toward an outer side in the left-right direction so as to extend to the contact member 220 in a manner slanted. Further, the inclined surface 122 directly connects to the end surface 120A of the blade rubber part 120 in the left-right direction.

Meanwhile, an angle of the inclined surface 122 to the axial direction of the developing roller 31 can be, for example, 30° to 60°. Further, a width in the left-right direction of the inclined surface 122 can be, for example, 0.5 to 3 mm, preferably 1 to 3 mm.

Further, the cutout portion 121 is formed with a first side surface 123 and a second side surface 124. The first side surface 123 extends along the axial direction of the developing roller 31 toward the inner side in the left-right direction from an upper end 122B of the inclined surface 122. The second side surface 124 extends downward from the first side surface 123.

A length in the left-right direction of the first side surface 123 can be, for example, 3 to 6 mm, preferably 3 to 4 mm. Further, it is desirable that a lower end of the second side surface 124 is located at the outside of a nip portion (contact portion) between the developing roller 31 and the blade rubber part 120. Accordingly, a length in the front-rear direction of the second side surface 124 can be, for example, 1 to 3 mm.

Further, the upper end 122B and the lower end 122A of the inclined surface 122 are located at positions contacting the developing roller 31. The entire of the inclined surface 122 is provided within a range of the blade rubber part 120 contacting the developing roller 31 (a range shown by a dot hatching). Further, the first side surface 123 is also provided within the range of the blade rubber part 120 contacting the developing roller 31.

Figure 6A:
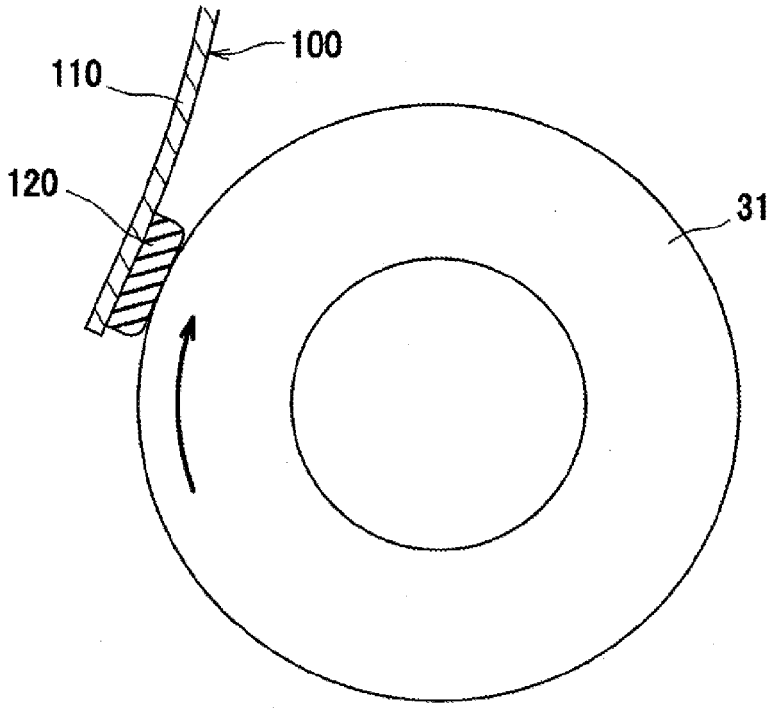
FIGS. 6A and 6B are views showing the developing roller and the layer thickness regulation blade.
Figure 6B:
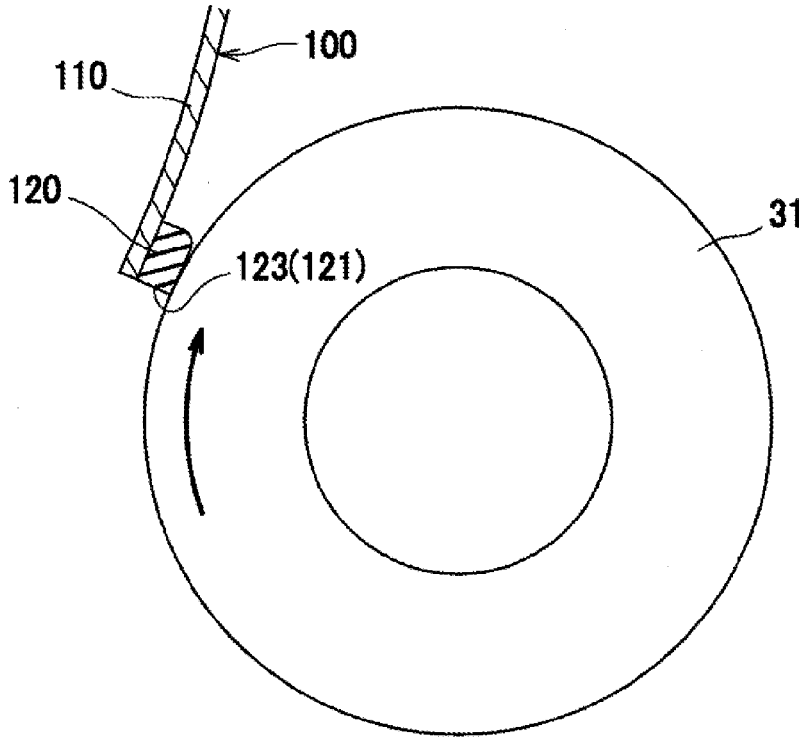

By providing such cutout portion 121 in the blade rubber part 120, the corners between the inclined surface 122, the first side surface 123 and the second side surface 124, and the surface of the blade rubber part 120, which is in contact with the developing roller 31, respectively, are substantially at right angles (see FIG. 6B).

The operation and effect of the developing cartridge 28 configured as described above will be described.

As shown in FIG. 6A, when the developing roller 31 is rotated, the toner on the developing roller 31 is scraped off by the blade rubber part 120 of the layer thickness regulation blade 100.

At this time, the portion of the developing roller 31, which is located at an inner side of the cutout portion 121 in the left-right direction, is in contact with the flat surface of the blade rubber part 120. In contrast, as shown in FIG. 6B, at the portion where the cutout portion 121 is provided, a corner of the blade rubber part 120, which is located at an upstream side in the rotating direction of the developing roller 31, is substantially at a right angle, and the corner of the blade rubber part 120 is in contact with the developing roller 31. Thereby, a larger amount of toner is scraped off at a position of the developing roller 31 corresponding to the cutout portion 121, as compared to a position of the developing roller 31 located at an inner side of the cutout portion 121 in the left-right direction.

With this configuration, a layer thickness of the toner carried on an end portion of the developing roller 31 is thinned, so that it is possible to suppress leakage of the toner from the end portion of the developing roller 31.

Further, in the illustrative embodiment, the cutout portion 121 is provided with the first side surface 123 extending along the axial direction of the developing roller 31. With this configuration, it is possible to scrape off a larger amount of toner by the first side surface 123, as compared to a configuration where the inclined surface 122 is directly connected to the second side surface 124 without providing the first side surface 123.

Figure 5A:
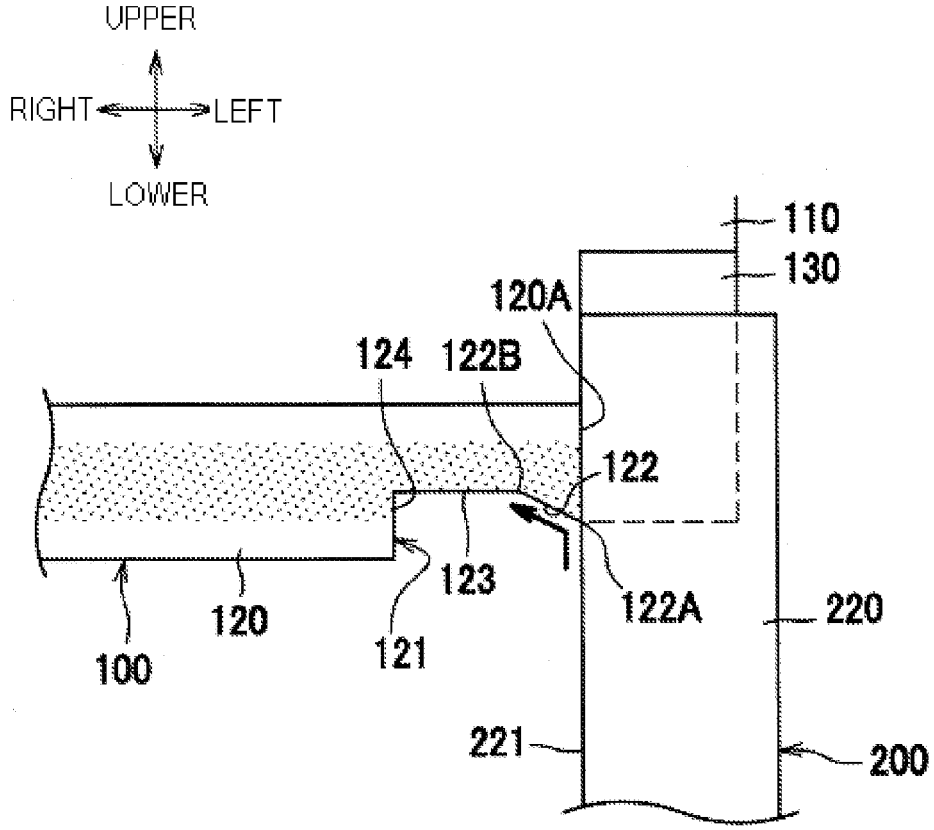
FIGS. 5A and 5B are views showing an end portion of a layer thickness regulation blade and a side seal.
Figure 5B:
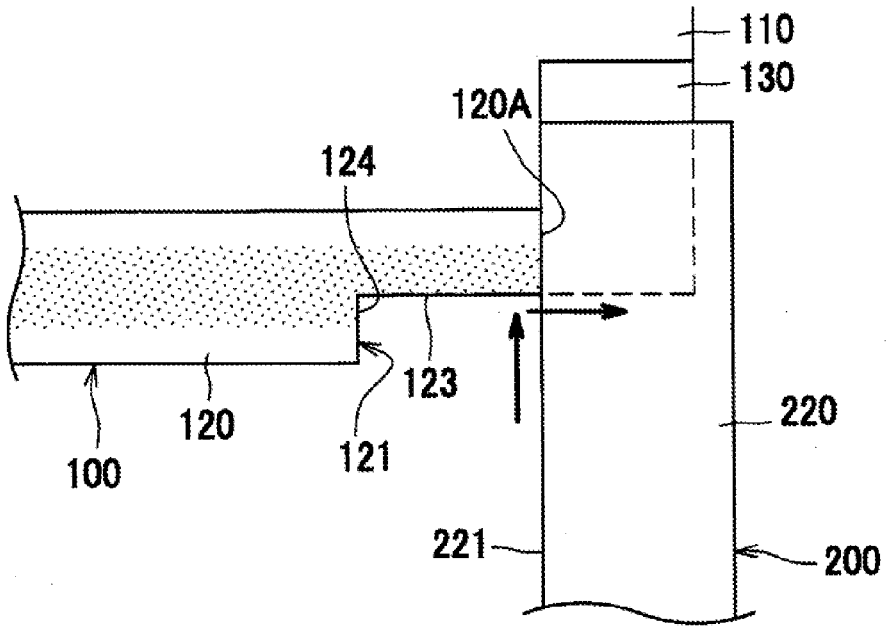

By the way, in the configuration where the blade rubber part 120 is provided with the cutout portion 121, sometimes, a large amount of toner scraped off by the cutout portion 121 moves along the first side surface 123 and vigorously flows to the contact member 220 if the inclined surface 122 is not provided to the blade rubber part 120 and the first side surface 123 extends to the contact member 220, as shown in FIG. 5B. Further, when the toner vigorously flows to the contact member 220, it is difficult to completely seal all of the toner by the contact member 220. Accordingly, there is a possibility that the toner is leaked.

In the illustrative embodiment, as shown in FIG. 5A, a large amount of toner scraped off by the inclined surface 122 of the blade rubber part 120 moves toward the side opposite to the side seal 200 along the inclined surface 122. Thereby, since the large amount of toner scraped off does not flow vigorously to the contact member 220, it is possible to suppress leakage of the toner.

Further, since the inclined surface 122 is provided within a range where the blade rubber part 120 is in contact with the developing roller 31, it is possible to suppress the inclined surface 122 from being partially worn.

Although the illustrative embodiment of the invention has been described, the invention is not limited thereto. The specific configuration can be appropriately modified without departing from the scope of the invention. In the following descriptions, the same or similar components will be denoted by the same reference numeral as that of the illustrative embodiment and a description thereof will be omitted.

Figure 7:
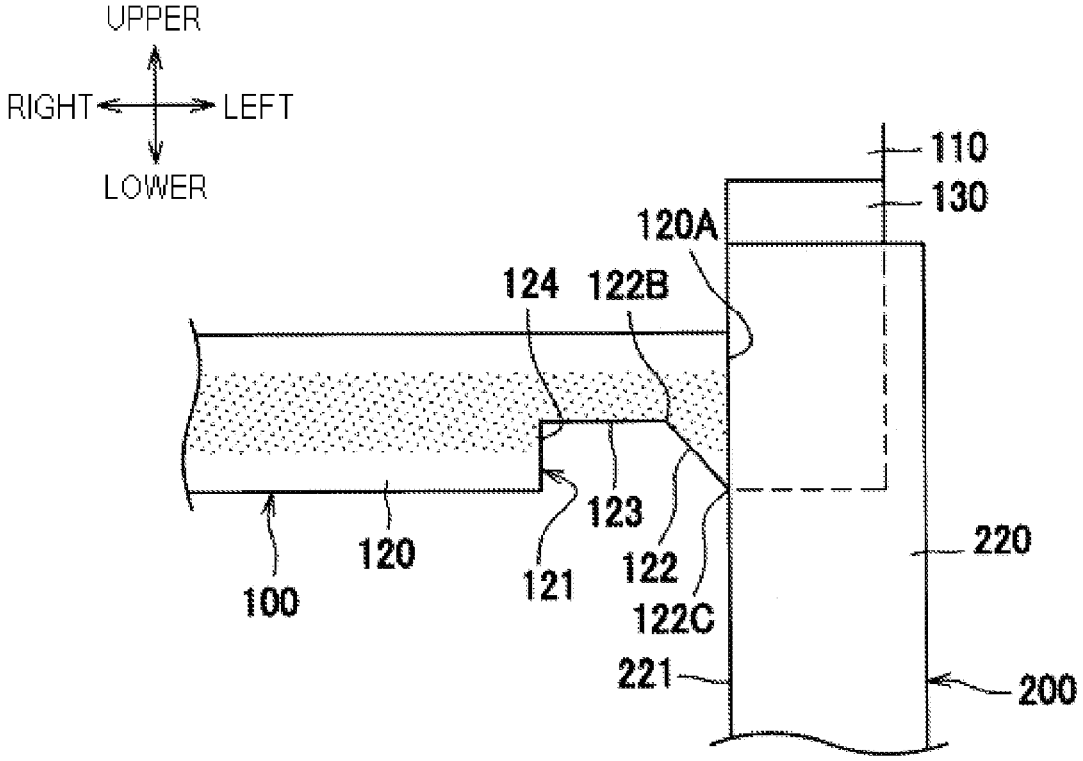
FIG. 7 is a view showing an end portion of a layer thickness regulation blade and a side seal in a first modified embodiment.

In the illustrative embodiment, the entire of the inclined surface 122 is provided within a range where the blade rubber part 120 is in contact with the developing roller 31. However, the configuration of the inclined surface 122 is not limited thereto. For example, as shown in FIG. 7, a part of the inclined surface 122 may be provided within the range where the blade rubber part 120 is in contact with the developing roller 31 and the other part thereof may be provided outside the range where the blade rubber part 120 is in contact with the developing roller 31. Specifically, a lower end 122C of the inclined surface 122 is provided at the same position in the upper-lower direction as a lower end of the second side surface 124, so that the inclined surface 122 is not in contact with the developing roller 31.

Figure 8:
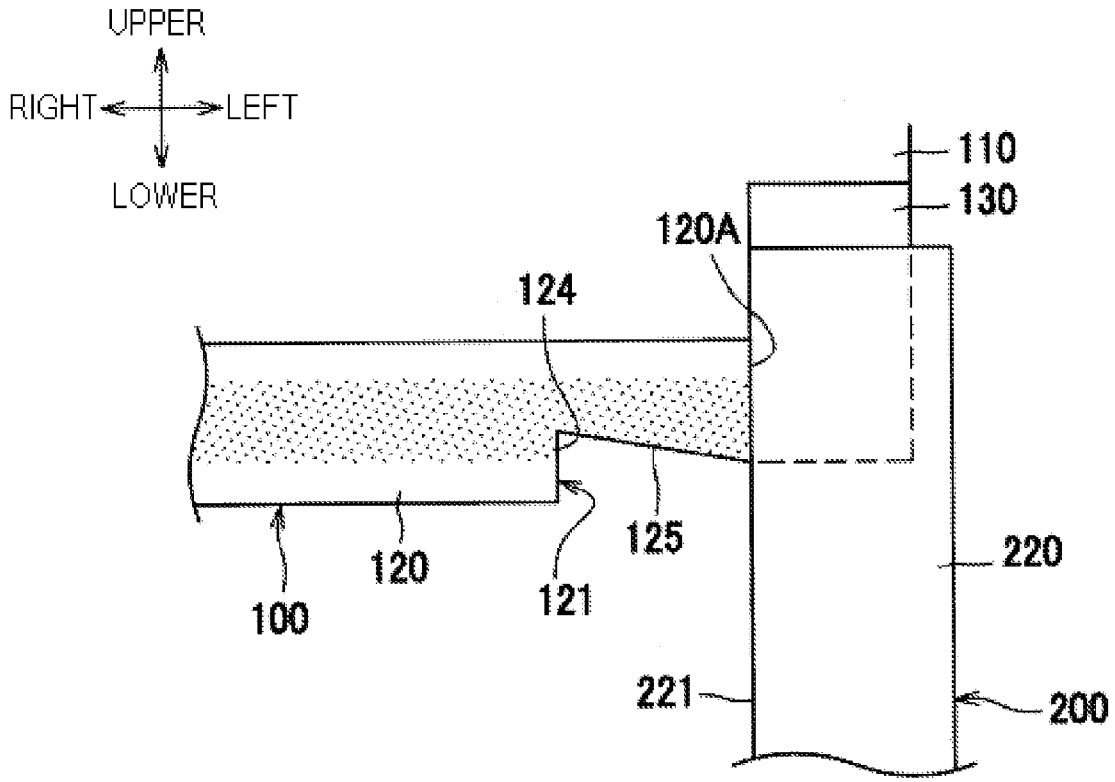
FIG. 8 is a view showing an end portion of a layer thickness regulation blade and a side seal in a second modified embodiment.

Further, in the illustrative embodiment, the cutout portion 121 is provided with the first side surface 123 extending along the axial direction of the developing roller 31. However, the shape of the cutout portion 121 is not limited thereto. For example, as shown in FIG. 8, an inclined surface 125 may be directly connected to the second side surface 124.

Figure 9:
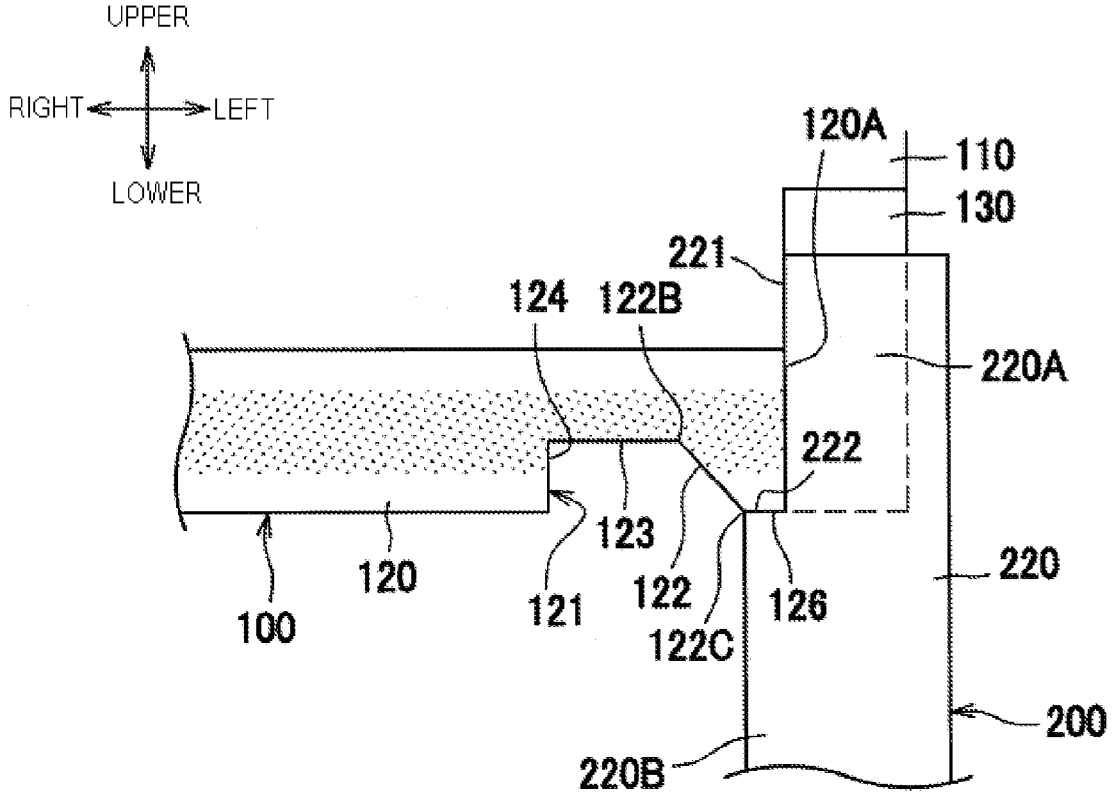
FIG. 9 is a view showing an end portion of a layer thickness regulation blade and a side seal in a third modified embodiment.

Further, in the illustrative embodiment, the inclined surface 122 is directly connected to the end surface 120A in the left-right direction of the blade rubber part 120. However, the configuration of the blade rubber part 120 is not limited thereto. For example, as shown in FIG. 9, the lower end 122C of the inclined surface 122 may be provided at a position shifted in the left-right direction from the end surface 120A.

Specifically, the blade rubber part 120 has a third side surface 126 extending outward in the left-right direction from the lower end 122C of the inclined surface 122 and connected to the end surface 120A of the blade rubber part 120 in the left-right direction.

The contact member 220 includes a first part 220A having the end surface 221 contacting the end surface 120A of the blade rubber part 120 and a second part 220B protruding inward in the left-right direction from the first part 220A. The inner end surface 221 of the first part 220A in the left-right direction and an upper end surface 222 of the second part 220B form a substantially L shape. Further, the upper end surface 222 of the second part 220B is in contact with the third side surface 126 of the blade rubber part 120.

By employing such a configuration, the contact area between the contact member 220 and the blade rubber part 120 is larger, as compared to a case where the contact member 220 and the blade rubber part 120 are in contact with each other only at the inner end surface 221 of the contact member 220 in the left-right direction and the end surface 120A of the blade rubber part 120 in the left-right direction. Accordingly, it is possible to suppress leakage of the toner.

Figure 10:
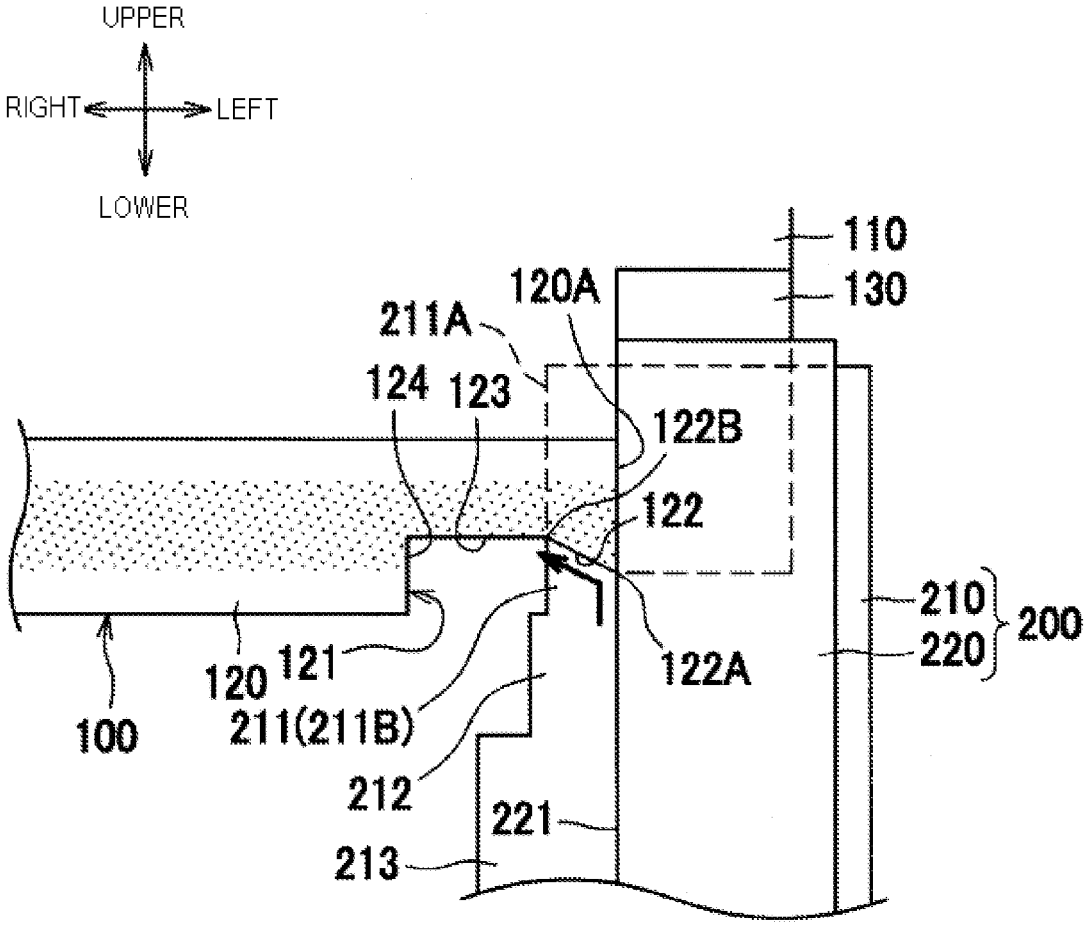
FIG. 10 is a view showing an end portion of a layer thickness regulation blade and a side seal in a fourth modified embodiment.

Further, as shown in FIG. 10, as an example of the suppression part for suppressing the strength of flow of the toner, a part of the base member 210 may be disposed at a corner part between the blade rubber part 120 and the contact member 220. Specifically, the base member 210 has a first protrusion 211, a second protrusion 212 and a third protrusion 213, all of which protrude toward the inner side in the left-right direction than the contact member 220, in a state where the contact member 220 is attached to the base member 210.

The layer thickness regulation blade 100 is arranged so as to be superimposed on a large area of the upper side 211A of the first protrusion 211 from the front side. A lower end portion 211B of the first protrusion 211 is disposed so as to protrude lower than the first side surface 123 of the cutout portion 121 of the blade rubber part 120. That is, the lower end portion 211B of the first protrusion 211 is disposed at the corner part between the blade rubber part 120 and the contact member 220, specifically, at the corner part formed by the inclined surface 122 of the cutout portion 121 and the inner end surface 221 of the contact member 220 in the left-right direction. In this way, the lower end portion 211B of the first protrusion 211 functions as the above-described suppression part.

By providing the suppression part as described above, when a large amount of toner scraped off by the cutout portion 121 of the blade rubber part 120 vigorously moves outward in the left-right direction along the first side surface 123, the strength of flow of the toner can be weakened by the first protrusion 211. Thereby, the large amount of toner scraped off does not flow vigorously to the contact member 220, so that it is possible to suppress leakage of the toner.

Further, a part of the base member 210 (lower end portion 211B of the first protrusion 211) functions as the suppression part for suppressing the strength of flow of the toner. Accordingly, it is possible to reduce the number of parts, as compared to a structure where the suppression part is configured by a member other than the existing parts such as the base member, for example.

Here, a length in the left-right direction of the first protrusion 211 can be, for example, 1 mm. However, the invention is not limited thereto. For example, the length in the left-right direction of the first protrusion 211 can be 0.5 to 3 mm, preferably 1 to 3 mm.

Further, a length in the upper-lower direction of the lower end portion 211B of the first protrusion 211 can be, for example, the same length (1.5 mm) as the second side surface 124. However, the invention is not limited thereto. For example, the length in the upper-lower direction of the lower end portion 211B of the first protrusion 211 can be 1 to 3 mm.

In a state where the developing roller 31 is attached to the housing 50 so as to be pressed against the layer thickness regulation blade 100 and the side seal 200 and the like, the first protrusion 211 may be or may not be in contact with the developing roller 31.

The second protrusion 212 is disposed adjacent to the first protrusion 211 at the upstream side in the rotating direction of the developing roller 31 and protrudes toward an inner side in the left-right direction than the first protrusion 211.

The third protrusion 213 is disposed adjacent to the second protrusion 212 at the upstream side in the rotating direction of the developing roller 31 and protrudes toward the inner side in the left-right direction than the second protrusion 212.

Meanwhile, an amount of protrusion of the second protrusion 212 to the first protrusion 211 can be, for example, 0.5 to 2 mm, preferably 0.5 to 1 mm. Further, an amount of protrusion of the third protrusion 213 to the second protrusion 212 can be, for example, 0.5 to 2 mm, preferably 1 to 1.5 mm.

In this way, since the second protrusion 212 protruding to the inner side in the left-right direction than the first protrusion 211 is provided at the upstream side of the first protrusion 211 in the rotating direction, the second protrusion 212 can suppress the toner from flowing toward the corner part between the blade rubber part 120 and the contact member 220. Accordingly, it is possible to further suppress the toner from vigorously flowing to the contact member 220.

Further, since the third protrusion 213 protruding to the inner side in the left-right direction than the second protrusion 212 is provided at the upstream side of the second protrusion 212 in the rotating direction, the third protrusion 213 can suppress the toner from flowing toward the corner part between the blade rubber part 120 and the contact member 220. Accordingly, it is possible to further suppress the toner from vigorously flowing to the contact member 220.

In the above-described illustrative embodiment, the invention has been applied to the developing cartridge 28 included in the laser printer 1. However, the invention can be also applied to a developing device included in other image forming apparatuses, for example, a copier, a complex machine and the like.

In the above-described illustrative embodiment, the invention has been applied to the developing cartridge 28. However, the invention is not limited thereto. For example, the invention can be also applied to another developing device such as a developing unit where toner is supplied from a toner cartridge accommodating the toner or a process cartridge where a developing cartridge and a drum unit are integrally configured.

The present invention provides illustrative, non-limiting aspects as follows:

(1) In a first aspect, there is provided a developing device including a housing configured to accommodate developer therein, a developing roller rotatably provided to the housing and configured to carry the developer on a surface thereof, a layer thickness regulation blade contacting the developing roller, and a seal member arranged between the housing and each end of the developing roller in an axial direction of the developing roller, wherein the layer thickness regulation blade includes a blade main body extending along the axial direction, and a blade rubber part protruding from a surface of the blade main body, which faces the developing roller, and contacting the developing roller, wherein an end surface of the blade rubber part in the axial direction is in contact with an inner surface of the seal member in the axial direction, and wherein the blade rubber part has an inclined surface at each end thereof in the axial direction, the inclined surface extending toward an upstream side in a rotating direction of the developing roller while extending toward an outer side in the axial direction so as to extend to the seal member.

Accordingly, since the developer scraped off by the inclined surface of the blade rubber part moves along the inclined surface, the developer moves toward the inner side of the developing roller in the axial direction, i.e., toward the side opposite to the seal member. Accordingly, since the developer scraped off by the inclined surface does not vigorously flow to the seal member, it is possible to suppress leakage of the developer.

(2) In a second aspect, there is provided the developing device according to the first aspect, wherein the inclined surface is provided within a range where the blade rubber part is in contact with the developing roller.

Accordingly, since the entire inclined surface is in contact with the developing roller, it is possible to suppress the inclined surface from being partially worn.

(3) In a third aspect, there is provided the developing device according to the first or second aspect, wherein the blade rubber part has a first side surface extending from a downstream-side end of the inclined surface in the rotating direction toward an inner side in the axial direction, and a second side surface extending from the first side surface toward an upstream side in the rotating direction.

(4) In a fourth aspect, there is provided the developing device according to any one of the first to third aspects, wherein the inclined surface directly connects to the end surface of the blade rubber part.

(5) In a fifth aspect, there is provided the developing device according to any one of the first to third aspects, wherein the blade rubber part has a third side surface extending from an upstream-side end of the inclined surface in the rotating direction toward an outer side in the axial direction and connected to the end surface, and wherein the seal member includes a first part contacting the end surface and a second part protruding toward an inner side in the axial direction than the first part and contacting the third side surface.

Accordingly, a contact area between the seal member and the blade rubber part is large, as compared to a case where the seal member and the blade rubber part are in contact with each other only at an inner end surface of the seal member in a left-right direction and an end surface of the blade rubber part in the left-right direction. Accordingly, it is possible to suppress leakage of the developer.

(6) In a sixth aspect, there is provided the developing device according to any one of the first to fifth aspects, wherein a suppression part configured to suppress a strength of flow of the developer is provided at a corner part between the blade rubber part and the seal member.

Accordingly, since the strength of flow of the developer is suppressed by the suppression part when the developer scraped off by the end portion of the blade rubber part is trying to vigorously move toward the seal member, it is possible to suppress the developer from vigorously flowing to the seal member. As a result, it is possible to suppress leakage of the developer.

(7) In a seventh aspect, there is provided the developing device according to the sixth aspect, wherein the seal member includes a contact member configured to contact the developing roller and an elastic member arranged between the contact member and the housing, wherein the elastic member has a first protrusion protruding toward an inner side in the axial direction than the contact member, wherein the end surface of the blade rubber part is in contact with an inner end surface of the contact member in the axial direction, and wherein the first protrusion is provided at a corner part between the blade rubber part and the contact member so as to function as the suppression part.

Accordingly, a part of the blade main body configures the suppression part. Accordingly, it is possible to reduce the number of parts, as compared to a structure where the suppression part is configured by a member other than the existing parts such as the blade main body, for example.

(8) In an eighth aspect, there is provided the developing device according to the seventh aspect, wherein the elastic member has a second protrusion arranged at an upstream side of the first protrusion in the rotating direction of the developing roller and protruding toward the inner side in the axial direction than the first protrusion.

Accordingly, since the second protrusion can suppress the developer from flowing toward the corner part between the blade rubber part and the contact member, it is possible to further suppress the developer from vigorously flowing to the seal member.

(9) In a ninth aspect, there is provided the developing device according to the eighth aspect, wherein the elastic member has a third protrusion arranged at an upstream side of the second protrusion in the rotating direction of the developing roller and protruding toward the inner side in the axial direction than the second protrusion.

Accordingly, since the third protrusion can suppress the developer from flowing toward the corner part between the blade rubber part and the contact member, it is possible to further suppress the developer from vigorously flowing to the seal member.

What is claimed is:

1. A developing device comprising:

a housing configured to accommodate developer therein;

a developing roller rotatably provided to the housing and configured to carry the developer on a surface thereof;

a layer thickness regulation blade contacting the developing roller; and a seal member arranged between the housing and each end of the developing roller in an axial direction of the developing roller, wherein the layer thickness regulation blade includes:

a blade main body extending along the axial direction, and a blade rubber part protruding from a surface of the blade main body, which faces the developing roller, and contacting the developing roller, wherein an end surface of the blade rubber part in the axial direction is in contact with an inner surface of the seal member in the axial direction, and wherein the blade rubber part has an inclined surface at each end thereof in the axial direction, the inclined surface extending upstream in a rotating direction of the developing roller while extending outwardly in the axial direction so as to extend to the seal member.

2. The developing device according to claim 1, wherein the inclined surface is provided within a range where the blade rubber part is in contact with the developing roller.

3. The developing device according to claim 1, wherein the blade rubber part has:

a first side surface extending from a downstream-side end of the inclined surface in the rotating direction toward an inner side in the axial direction, and a second side surface extending from the first side surface upstream in the rotating direction.

4. The developing device according to claim 1, wherein the inclined surface directly connects to the end surface of the blade rubber part.

5. The developing device according to claim 1, wherein the blade rubber part has a third side surface extending from an upstream-side end of the inclined surface in the rotating direction outwardly in the axial direction and connected to the end surface, and wherein the seal member includes a first part contacting the end surface and a second part protruding farther inwardly in the axial direction than the first part and contacting the third side surface.

6. The developing device according to claim 1, wherein a suppression part, configured to suppress a strength of flow of the developer, is provided at a corner part between the blade rubber part and the seal member.

7. The developing device according to claim 6, wherein the seal member includes a contact member configured to contact the developing roller and an elastic member arranged between the contact member and the housing, wherein the elastic member has a first protrusion protruding toward more inwardly in the axial direction than the contact member, wherein the end surface of the blade rubber part is in contact with an inner end surface of the contact member in the axial direction, and wherein the first protrusion is provided at a corner part between the blade rubber part and the contact member so as to function as the suppression part.

8. The developing device according to claim 7, wherein the elastic member has a second protrusion arranged upstream of the first protrusion in the rotating direction of the developing roller and protruding farther inwardly in the axial direction than the first protrusion.

9. The developing device according to claim 8, wherein the elastic member has a third protrusion arranged upstream of the second protrusion in the rotating direction of the developing roller and protruding farther inwardly in the axial direction than the second protrusion.

* * * * *